US009145885B2

(12) United States Patent
Bouldin et al.

(10) Patent No.: US 9,145,885 B2
(45) Date of Patent: Sep. 29, 2015

(54) ELECTRICAL SUBMERSIBLE PUMP WITH RECIPROCATING LINEAR MOTOR

(75) Inventors: Brett W. Bouldin, Dhahran (SA); Jinjiang Xiao, Dhahran (SA)

(73) Assignee: Saudi Arabian Oil Company (SA)

( * ) Notice: Subject to any disclaimer, the term of this patent is extended or adjusted under 35 U.S.C. 154(b) by 242 days.

(21) Appl. No.: 13/089,102

(22) Filed: Apr. 18, 2011

(65) Prior Publication Data

US 2012/0263606 A1 Oct. 18, 2012

(51) Int. Cl.

| | |
|---|---|
| ***F04B 47/00*** | (2006.01) |
| ***F04B 47/02*** | (2006.01) |
| ***F04B 47/06*** | (2006.01) |
| ***E21B 43/12*** | (2006.01) |

(52) U.S. Cl.
CPC ..... *F04B 47/02* (2013.01); *E21B 43/128* (2013.01); *F04B 47/06* (2013.01)

(58) Field of Classification Search
CPC ..... F04B 47/00; F04B 47/06
USPC ..... 417/392; 310/11, 26
See application file for complete search history.

(56) References Cited

U.S. PATENT DOCUMENTS

| | | | | |
|---|---|---|---|---|
| 2,242,166 | A * | 5/1941 | Bennett | 166/105 |
| 2,797,642 | A * | 7/1957 | Bloudoff | 166/54.1 |
| 3,741,298 | A * | 6/1973 | Canton | 166/105 |
| 4,018,547 | A | 4/1977 | Rogen | |
| 4,472,113 | A * | 9/1984 | Rogen | 417/321 |
| 4,548,263 | A * | 10/1985 | Woods | 166/105 |
| 4,804,314 | A | 2/1989 | Cusack | |
| 4,815,946 | A | 3/1989 | Cusack | |
| 4,927,334 | A | 5/1990 | Engdahl et al. | |
| 5,558,504 | A * | 9/1996 | Stridsberg | 417/322 |
| 5,630,709 | A | 5/1997 | Bar-Cohen | |
| 5,816,780 | A | 10/1998 | Bishop et al. | |
| 5,992,296 | A | 11/1999 | Murata | |
| 6,015,266 | A * | 1/2000 | Swatek | 417/53 |
| 6,042,345 | A | 3/2000 | Bishop et al. | |
| 6,071,088 | A | 6/2000 | Bishop et al. | |
| 6,074,178 | A | 6/2000 | Bishop et al. | |
| 6,321,845 | B1 * | 11/2001 | Deaton | 166/363 |
| 6,623,256 | B2 | 9/2003 | Takagi et al. | |
| 7,011,507 | B2 | 3/2006 | Seto et al. | |
| 7,111,675 | B2 | 9/2006 | Zisk, Jr. | |
| 7,484,940 | B2 | 2/2009 | O'Neill | |
| 8,020,616 | B2 * | 9/2011 | Greenaway | 166/254.2 |
| 2005/0034871 | A1 * | 2/2005 | Scarsdale | 166/369 |
| 2007/0274849 | A1 * | 11/2007 | Martinez | 417/423.3 |
| 2009/0311116 | A1 | 12/2009 | Bai et al. | |
| 2010/0012313 | A1 | 1/2010 | Longfield et al. | |
| 2010/0025032 | A1 | 2/2010 | Smith et al. | |
| 2010/0074776 | A1 | 3/2010 | Ludlow et al. | |

OTHER PUBLICATIONS

PCT Int'l Search Report and the Written Opinion dated Jul. 30, 2013; Int'l Application No. PCT/US2012/033994; Int'l Filing Date: Apr. 18, 2012.

* cited by examiner

*Primary Examiner* — Charles Freay
*Assistant Examiner* — Christopher Bobish
(74) *Attorney, Agent, or Firm* — Bracewell & Giuliani LLP; Constance Gall Rhebergen; Linda L. Morgan

(57) ABSTRACT

A reciprocating pump, actuated by an expandable material, can be used to pump well fluids from a wellbore toward the surface of the earth. The expandable material can include piezoelectric, electrostriction, magnetostrictive, or piezomagnetic material. By using the expandable material, the pump can be sufficiently small to fit in various types of tubing within a wellbore.

28 Claims, 4 Drawing Sheets

ELECTRICAL SUBMERSIBLE PUMP WITH RECIPROCATING LINEAR MOTOR

BACKGROUND OF THE INVENTION

1. Technical Field of the Invention

This invention generally relates to the field of electrical submersible pumps and in particular to an electrical submersible pump having a reciprocating linear motor.

2. Description of the Related Art

Electrical submersible pumps ("ESP") can be used to produce fluids from a wellbore. Conventional ESPs are rotary pumps or push-rod reciprocating pumps. The rotary pumps generally include an electric motor that rotates one or more impellers. The push-rod reciprocating pumps generally include an actuating rod that is driven by a motor located on the surface of the earth.

Both types of conventional pumps can have a diameter that is too large to fit through various types of tubing that may be used within a wellbore. Furthermore, the conventional ESPs can be so big that they require substantial equipment on a drilling rig to insert them into a wellbore. Therefore, it is desirable to have a pump that can be sufficiently small to fit within tubing and be deployed without a drilling rig.

SUMMARY OF THE INVENTION

A linear pump can be used pumping wellbore fluids. The linear pump can include a pump body, a chamber located within the pump body, a piston located within the chamber, and an actuator that has an expandable material. The expandable material can change from a first shape to a second shape in response to a stimulus, and the change from the first shape to the second shape can cause the piston to move axially from a first piston position to a second piston position. The linear pump can also include a first port, the first port being an opening through a surface of the pump body and being in communication with the chamber. The first port can be operable to allow fluid to pass through the port. The linear pump can also have a second port in communication with the chamber.

In one embodiment, the first port can include a switch. In one embodiment, the first port is controlled with a valve. The linear pump can also include a stimulus generator connected to the pump. The stimulus can be provided by the stimulus generator. In one embodiment, the stimulus is an electrical charge. In one embodiment, the stimulus is a magnetic field. A power supply can be located on the surface of the earth and is connected to the stimulus generator.

The expandable material can include various materials, such as piezoelectric, electrostriction, magnetostrictive, and piezomagnetism properties. In one embodiment, the linear pump is adapted to be submerged in a wellbore fluid in a wellbore and draw the wellbore fluid into the chamber in response to movement of the piston. In one embodiment, the linear pump can be adapted to be located in a wellbore and urge a wellbore fluid toward the surface of the earth. In one embodiment, the linear pump is adapted to be located in a wellbore and inject a fluid from the surface of the earth into the wellbore. In one embodiment, the pump can intake a fluid from one subterranean wellbore zone and discharge the fluid into a different subterranean wellbore zone.

In one embodiment, a system can be used for pumping wellbore fluid. The system can include a first linear pump, the first linear pump can have a pump body having an exterior surface, a chamber located within the pump body, and a piston located within the chamber. The linear pump can also include an actuator that includes an expandable material and a stimulus generator, the expandable material changing from a first shape to a second shape in response to a stimulus from the stimulus generator, the change from the first shape to the second shape causing the piston to move axially from a first piston position to a second piston position; and a power supply to transmit power to the stimulus generator. In one embodiment, the system can have a first port, the first port being an opening through the exterior surface of the pump body that is in communication with the chamber and can be operable to allow fluid to flow through the port. In one embodiment, the first linear pump is adapted to be submerged in a wellbore fluid in a wellbore and draw wellbore fluid from the wellbore, through the first port, into the chamber when the piston moves from the first piston position to the second piston position. In one embodiment, the system can include a second port and well production tubing, the first linear pump being located within the well production tubing and the second port adapted to communicate fluid between the chamber and the well production tubing. In one embodiment, the power supply can be located on the surface of the earth. One embodiment can include an annular packer forming a seal between the exterior surface and a portion of the well production tubing. The system can also have a second linear pump, the second linear pump. That second linear pump can have a pump body having an exterior surface, a chamber located within the pump body, a first port, the first port being an opening through the exterior surface of the pump body and being in communication with the chamber, a second port, the second port being in communication with the chamber, a piston located within the chamber, and an expandable material, the expandable material changing from a first shape to a second shape in response to an electrical stimulus from a stimulus generator, the change from the first shape to the second shape causing the piston to move axially from a first piston position to a second piston position. In one embodiment, the first linear pump and the second linear pump can be spaced axially apart in the well production tubing.

In one embodiment, the system can include a bypass tube, wherein the fluid pumped from the first pump bypasses the second pump. An umbilical can be connected to the power supply and at least the first linear pump and the second linear pump. In one embodiment, the first linear pump can be located in a wellbore and inject fluids from the surface of the earth into the wellbore. In one embodiment, the first linear pump can intake fluid from one subterranean wellbore zone and discharge it into a different subterranean wellbore zone.

In one embodiment, a method for pumping wellbore fluid from a wellbore is described. The method can include creating a linear pump having a chamber, the chamber defined by a sidewall, and a piston, the chamber having an inlet valve connected to a passage through the sidewall and an expandable material in axial alignment with the piston to define a reciprocating linear motor pump; submerging the reciprocating linear motor pump in a wellbore fluid in a wellbore; applying alternating electric current to axially contract the expandable material to cause the piston to draw the wellbore fluid from outside the reciprocating linear motor pump, through the inlet valve, into the chamber, the outlet valve closing to prevent wellbore fluid from the tubing from entering the chamber and the inlet valve opening to allow wellbore fluid from outside the reciprocating linear motor pump to enter the chamber and then axially extending the expandable material to cause the piston to push wellbore fluid out of the chamber through the outlet valve, the inlet valve closing to prevent wellbore fluid from exiting the chamber through the inlet valve and the outlet valve opening to allow wellbore fluid to exit the chamber through the outlet valve; and applying alternating electric current to cause the expandable material to extend and contract.

In one embodiment, the method can include the step of placing a second reciprocating linear motor pump in the wellbore, the second reciprocating linear motor pump being spaced axially apart from the reciprocating linear motor pump. In one embodiment, the method can include the step of placing a packer on the tubing between the reciprocating linear motor pump and the second reciprocating linear motor pump to isolate the inlet valves of the pumps from one another. The packer can isolate a first wellbore region from a second wellbore region, and the method can further include the step selectively pumping from one of the wellbore regions. In various embodiments, the wellbore fluid is pumped from the wellbore to the surface of the earth or the wellbore fluid is pumped from the surface of the earth into the wellbore.

In one embodiment, a linear pump for pumping wellbore fluids is described. The linear pump can include a pump body, a chamber located within the pump body, a piston located within the chamber; and an actuator comprising an expandable material, the expandable material changing from a first shape to a second shape in response to a stimulus, the change from the first shape to the second shape causing the piston to move axially from a first piston position to a second piston position, the piston being adapted to move wellbore fluid when moving from the first piston position to the second piston position.

DETAILED DESCRIPTION OF THE INVENTION

The present invention will now be described more fully hereinafter with reference to the accompanying drawing which illustrates embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
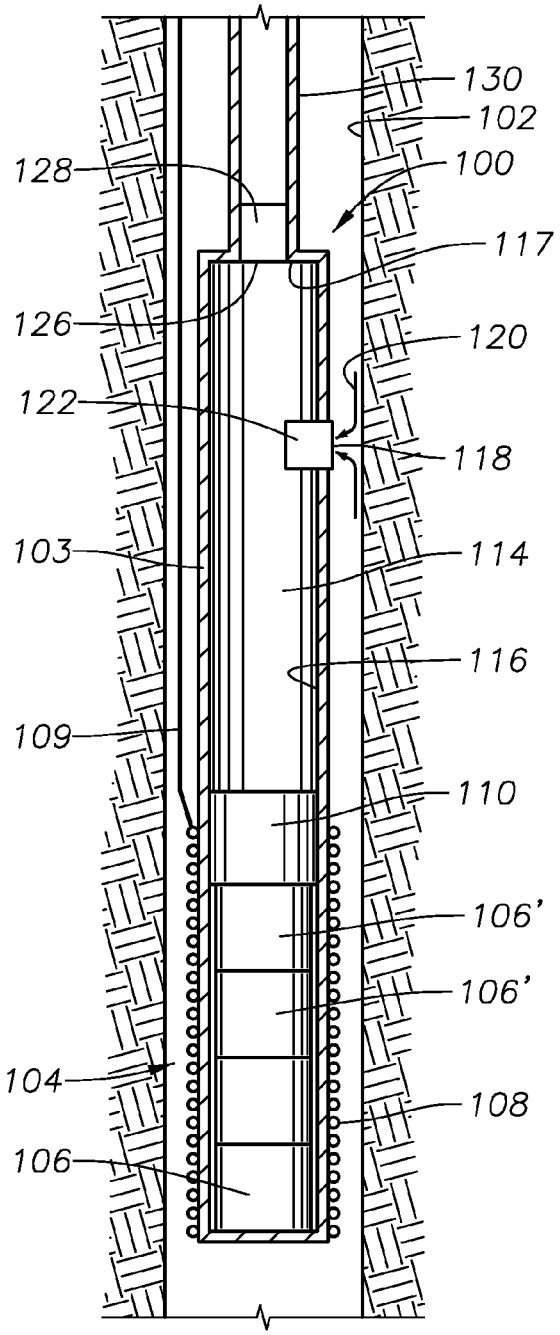
FIG. 1 is a sectional view of an exemplary embodiment of a linear pump in a wellbore.

Referring to FIG. 1, linear pump 100 can be a reciprocating pump located in wellbore 102. Wellbore 102 can be a subterranean well for recovering fluids located in formations within the depths of the earth. Wellbore fluids can include any type of fluid in a wellbore, including, for example, hydrocarbon liquids, hydrocarbon gasses, naturally occurring water-drive water, secondary-recovery injected water, potable water, and secondary recovery gasses.

Linear pump 100 can include pump body 103, and be powered by an actuator such as linear motor 104. Linear motor 104 can include expandable material 106. Expandable material 106 can be a material that grows or shrinks in response to a stimulus. The stimulus can come from various types of stimulus generators. For example, expandable material 106 can be a piezoelectric material, wherein the application of electrical current causes the material to grow. Expandable material 106 can be an electrostriction material, wherein the material shrinks in response to electric current. Alternatively, expandable material 106 can be a material that grows or shrinks in response to a magnetic field. For example, expandable material 106 can be a piezomagnetic material that expands when a magnetic field is applied. Alternatively, expandable material 106 can be a magnetostrictive material that contracts when a magnetic field is applied. In one embodiment, expandable material 106 can include a stack of individual elements 106'. Each element 106' can expand and contract, giving a larger cumulative expansion and contraction than might otherwise be achieved. In one embodiment, linear pump 100 does not use any bearings and, thus, there are no bearings to fail during operation.

In embodiments using magnetostrictive or piezomagnetic materials, the stimulus generator can include an electromagnetic coil 108, which can be used to generate a magnetic field. The electromagnetic coil can be a coil wrapped around all or a portion of expandable material 106. A power supply, which can include power cable 109, can be used to provide electricity to the stimulus generator. As electric current is applied or removed from coil 108, the piezomagnetic or magnetostrictive materials responsively expand or contract which, in turn, can drive piston 110 back and forth within chamber 114. Chamber 114 can be a vessel through which wellbore fluid is pumped. Chamber 114 can have a generally cylindrical shape, or other shapes can be used. Sidewall 116 can define the sides of the cylinder. The face of piston 110 can define an end of the cylinder. The other end of the cylinder can be defined by top 117. Thus, piston 110, sidewall 116 and top 117 can define chamber 114. The exterior of linear pump 100 can be a portion or surface the surface of pump 100 that is in contact with wellbore fluid, before the fluid is drawn into chamber 114, when linear pump 100 is submerged in wellbore fluid in a wellbore.

Piston 110 can be a piston that is connected to expandable material 106 such that it moves bi-directionally in response to the expansion and contraction of material 106. Alternatively, piston 110 can be connected to a spring (not shown) that causes piston 110 to move in one direction after material 106 has caused the piston 110 to move in the opposite direction. Piston 110 can be sized to be approximately the diameter of chamber 114. In one embodiment, piston 110 can have a sealing ring (not shown) to provide a relatively fluid tight seal between piston 110 and sidewall 116 of chamber 114.

Port 118 can be a passage that can communicate wellbore fluid 120 between wellbore 102 and chamber 114. In one embodiment, port 118 can be through sidewall 116, as shown in FIG. 1. Alternatively, port 118 can pass through top 117 or other locations into chamber 114. Valve 122 can control the flow of fluid in or out of chamber 114. Valve 122 can be a switch that employs any fluid flow technique to control the flow of fluid between the exterior of linear pump 100 and chamber 114 by, for example, stopping flow, allowing fluid to flow in only a particular direction, or allowing free flow. Valve 122 can be connected to port 118. Port 118 and valve 122 can be sufficiently large to allow wellbore fluids to pass therethrough.

In one embodiment, valve 122 is an inlet one-way valve that can allow wellbore fluid 120 to enter chamber 114, but prevent fluid within chamber 114 from passing back out through port 118. Valve 122 can be any type of valve that can permit fluid to pass in one direction, either in or out, but not in the other direction. For example, valve 122 can be a mechanical check valve. Alternatively, valve 122 can be an active check valve. One of skill in the art will appreciate that an active check valve can be a powered check valve that can open or close in response to a stimulus, such as a change in pressure differential on either side of the valve. In another embodiment, valve 122 can be a bi-directional one-way valve, wherein the valve can function as a one-way valve in either direction. Thus, valve 122 can allow fluid to enter chamber 114 but not exit chamber 114, or it can allow fluid to exit chamber 114 but not enter chamber 114.

Outlet port 126 can communicate fluid between chamber 114 and an area outside of chamber 114 such as into tubing 130 or to the exterior of linear pump 100. Valve 128 can be a switch that controls the flow of fluid in or out of chamber 114 by, for example, stopping flow, allowing fluid to flow in only a particular direction, or allowing free flow. Valve 128 can be connected to port 126. Port 126 and valve 128 can be sufficiently large to allow wellbore fluids to pass therethrough. In one embodiment, valve 128 can be a one-way valve that can permit fluid to pass out of chamber 114, but prevent fluid from entering chamber 114. The fluid that exits chamber 114, through outlet port 126, can be pumped through tubing 130 toward the surface of the earth. Tubing 130 can be production tubing or any other kind of pipe or tubing.

Pump 100 can be submerged in wellbore fluid in a wellbore. Indeed, pump 100 is adapted to withstand the temperature, pressure, and pH associated with a subterranean wellbore. As the pump operates, the expandable material can cause the piston to move away from top 117, thus increasing the volume of chamber 114. This process can draw wellbore fluid through port 118 into chamber 114. The expandable material 106 can then cause the piston 110 to move toward top 117, which can cause valve 122 to close, thus preventing wellbore fluid from passing out of chamber 114 back into wellbore 102. The increased pressure of the wellbore fluid inside chamber 114 can cause valve 128 to open, and the fluid can be forced out through outlet port 126, into tubing 130, toward the surface of the earth. In one embodiment, the fluid pumped through chamber 114 includes only wellbore fluid drawn from the wellbore 102, which was not contained in any manufactured reservoir prior to entering chamber 114. In one embodiment, the fluid that is pumped through chamber 114 is not recirculated back into chamber 114. In another embodiment, pump 100 can be used to inject fluid into the wellbore. For example, fluid can be moved from the surface of the earth, or from another subterranean wellbore zone, and discharged into the subterranean wellbore zone in which pump 100 is located. Embodiments using switches such as bi-directional valves can be used to withdraw fluid from the wellbore or inject fluid into the wellbore by switching the configuration of the bi-directional one-way valves.

Figure 2:
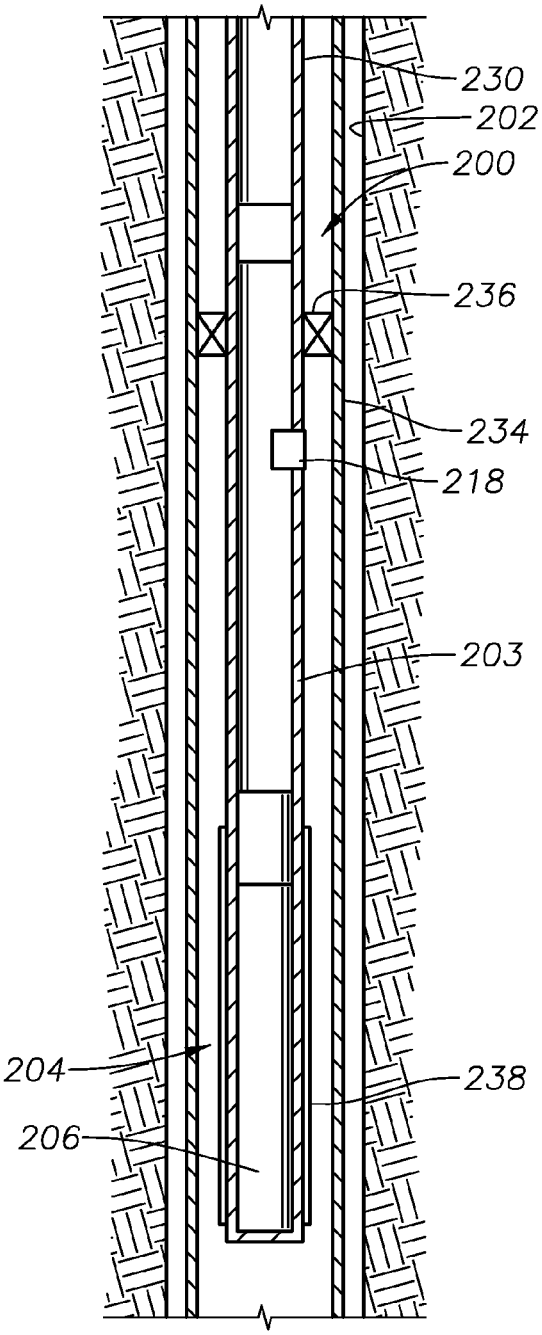
FIG. 2 is a sectional view of another embodiment of the linear pump of FIG. 1.

Referring to FIG. 2, linear pump 200 is shown in wellbore 202. In this embodiment, the outer diameter of pump body 203 is approximately the same diameter as tubing 230 from which it is suspended. In one embodiment, the outer diameter of pump body 203 is sufficiently small to permit pump 200 to be deployed through production tubing 234. The nature of linear pump 200, and its linear motor 204, permits pump 200 to be deployed through relatively narrow tubing. For example, linear pump 200, like linear pump 100 (FIG. 1) can have a smaller outer diameter than a rotary pump or a conventional reciprocating pump. In one embodiment, packer 236 can sealingly engage linear pump 200 and the inner diameter surface of production tubing 234. Thus, the inlet port 218 can be isolated from another portion of the wellbore.

In one embodiment, the linear motor 204 can be actuated in response to electric current. For example, the expandable material 206 in linear motor 204 can be a piezoelectric material, wherein the material grows in response to electric current. In another embodiment, expandable material 206 can be an electrostriction material, wherein the material contracts in response to electric current. The stimulus generator can include electrodes 238, which can be used to provide electric current to the expandable material.

Figure 3:
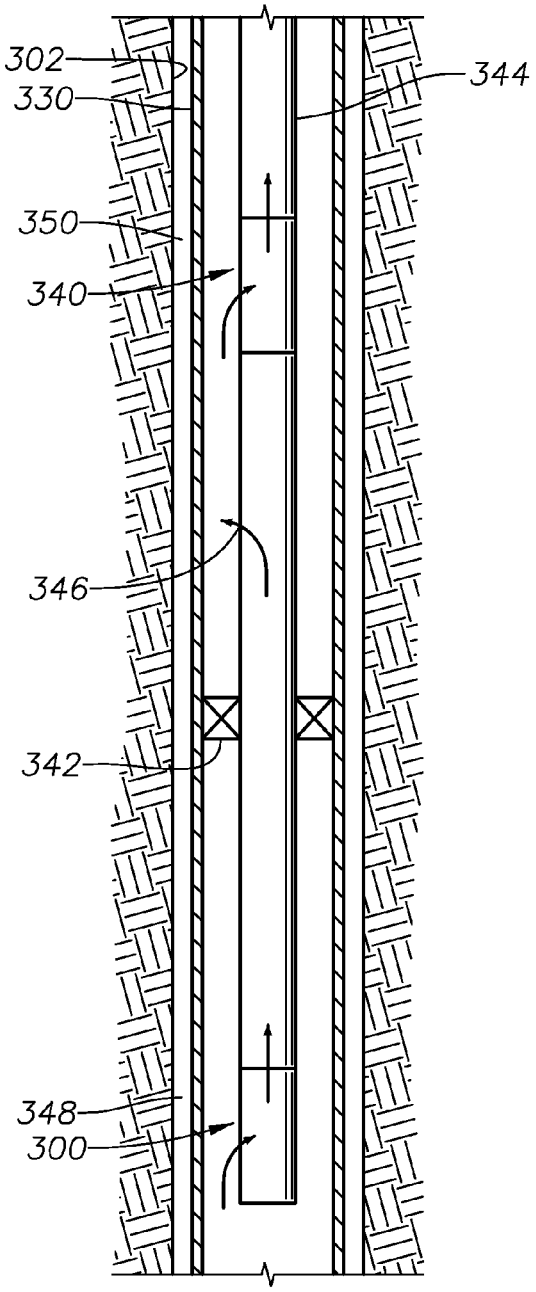
FIG. 3 is a sectional view of an embodiment having a plurality of linear pumps located within a length of tubing in a wellbore.

Referring to FIG. 3, in one embodiment, a pumping system can include multiple linear pumps. For example, a wellbore 302 can include linear pump 300 and another linear pump 340 that is axially spaced apart from linear pump 300. The pumps 300, 340 can both be in the same tubing 330. In one embodiment, the pumps 300, 340 can be isolated from one another by packer 342 such that the pumps 300, 340 can independently pump from different wellbore regions, or subterranean wellbore zones. For example, pump 300 can be in subterranean wellbore zone 348, while pump 340 can be in subterranean wellbore zone 350. Subterranean wellbore zone 348 could be, for example, a higher or lower pressure region than subterranean wellbore zone 350. It could be useful to operate both pumps, but pump a greater volume from one pump than from the other pump.

In one embodiment, pumps 300 and 340 can each pump fluid through production tubing 344. In this embodiment, each of the linear pumps can be suspended from the same production tubing 344 within tubing 330. In one embodiment, production tubing 344 can have a tubing outlet 346 such that fluid from pump 300 is pumped upward through tubing 330 and then exits tubing 330 through tubing outlet 346. Subsequently, the fluid that was pumped by linear pump 300, which can be mixed with wellbore fluid from production region 350, can enter pump 340 and be further pumped toward the surface.

Figure 4:
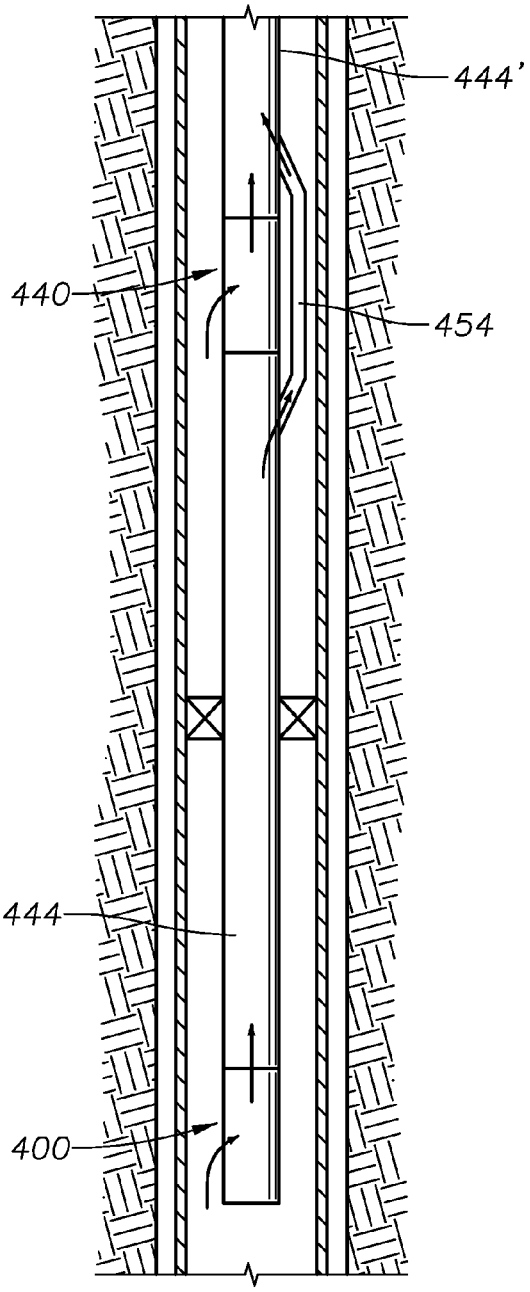
FIG. 4 is a sectional view of an embodiment having a plurality of linear pumps located within a length of tubing in a wellbore, wherein fluid pumped by one of the pumps can bypass another of the pumps.

In one embodiment, as shown in FIG. 4, bypass tube 454 can be used to pass fluid around a downstream linear pump 440. In this embodiment, fluid pumped from pump 400 can travel upward through production tubing 444 to bypass tube 454. That fluid can travel through bypass tube 454 and then continue through production tubing 444' toward the surface of the earth. Meanwhile, linear pump 440 can pump fluid, or not pump fluid, into production tubing 444'.

Figure 5:
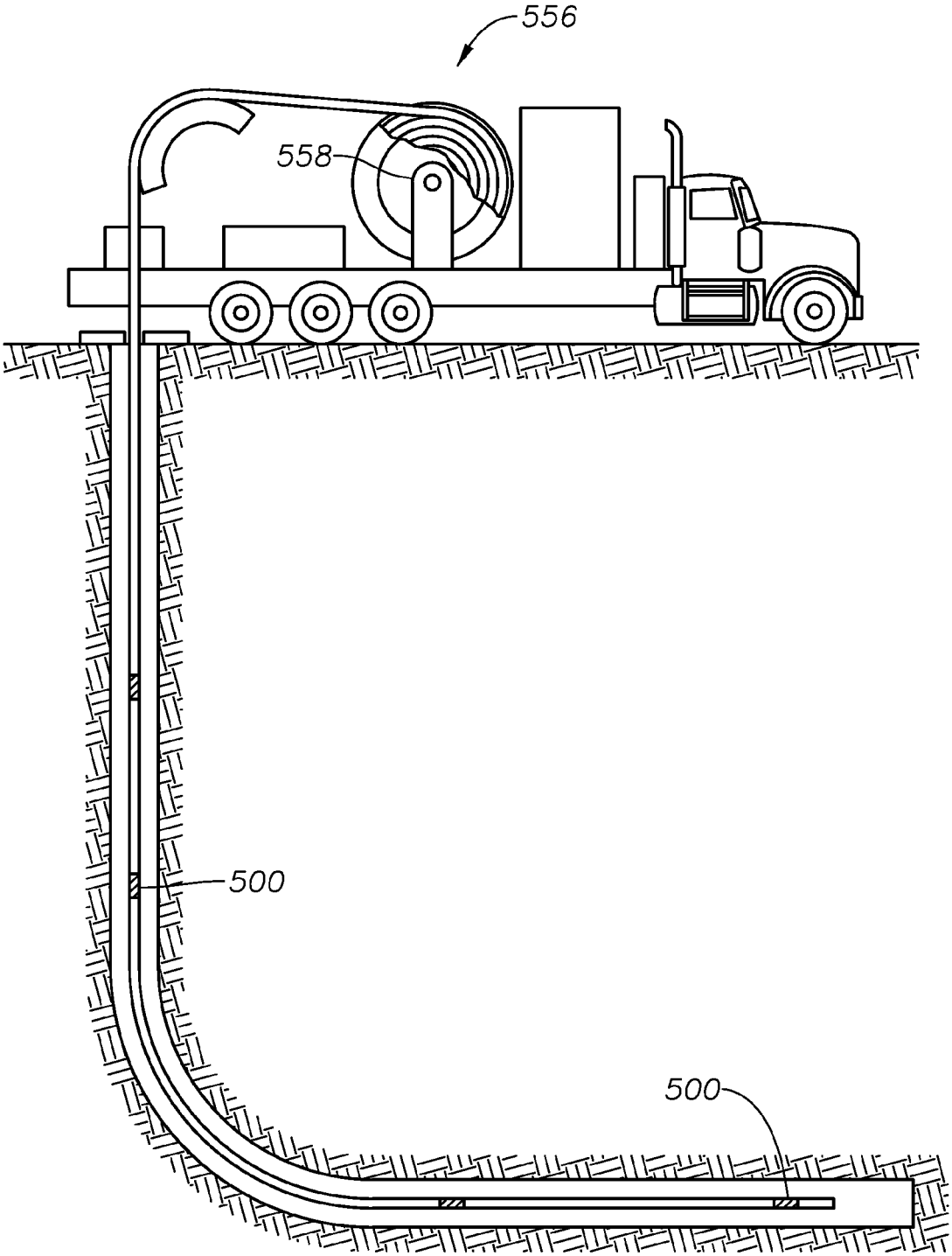
FIG. 5 is a diagrammatic view of an embodiment of the pump of FIG. 1, wherein a plurality of pumps are located within tubing.

Referring to FIG. 5, in one embodiment, each linear pump 500 can have an axial length and a width, or diameter, that are each sufficiently small to permit each linear pump 500 to be used with coiled tubing 556. Coiled tubing 556 can be any diameter including, for example, approximately 1" to 3.25". Coiled tubing 556 can be deployed by a variety of techniques including, for example, from a reel 558. Coiled tubing 556 can be deployed into a wellbore without the use of a drilling derrick. Therefore, a drilling derrick or drilling rig is not necessary to deploy some embodiments of linear pump 500.

Linear pumps 500 can be deployed anywhere in a wellbore. For example, the linear pumps 500 can be in a vertical or horizontal application within the wellbore. In one embodiment having multiple linear pumps 500 located within a wellbore, each can be selectively activated to pump fluid.

Figure 6:
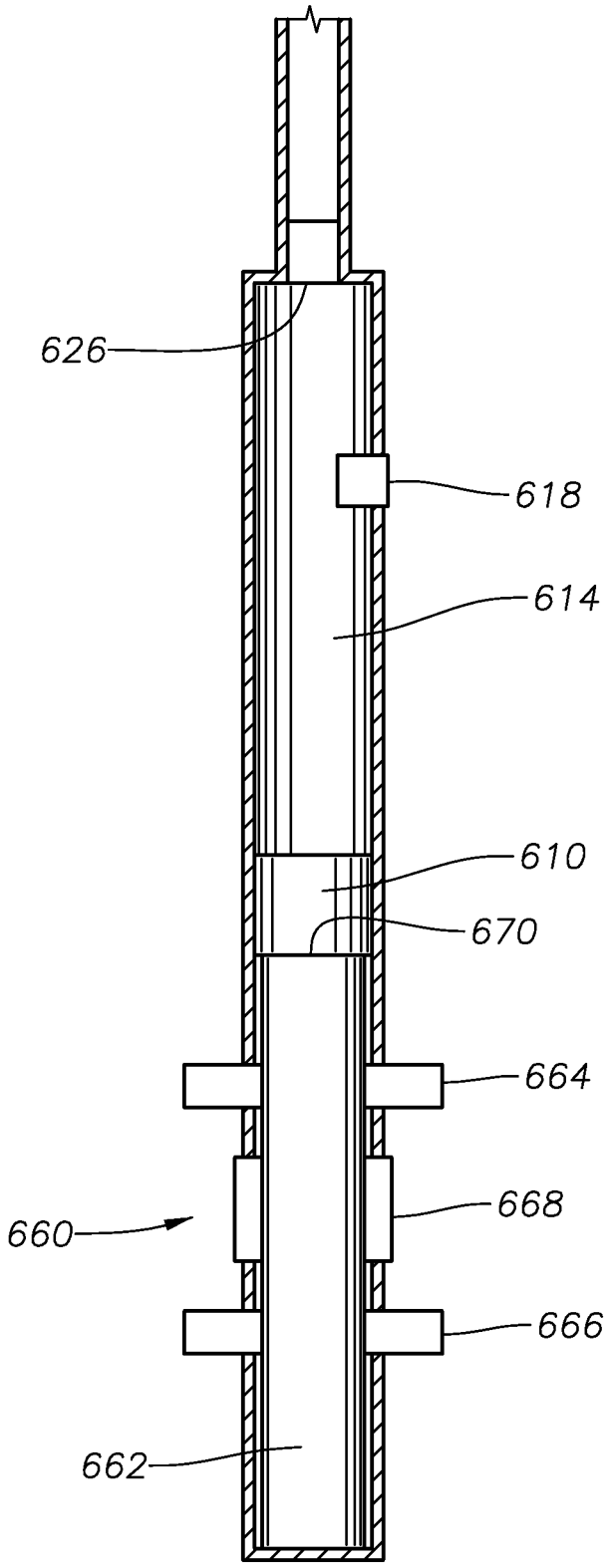
FIG. 6 is a diagrammatic view of an embodiment of the pump of FIG. 1 having an "inchworm" type linear motor.

Referring to FIG. 6, in one embodiment, the linear pump can use an "inchworm" motor 660. As one of skill in the art will appreciate, the inchworm motor can have an expandable element 662, a first grippers 664, and a second grippers 666. The grippers 664 and 666 can be an expandable material, each with its own stimulus generator (not shown). Alternatively, the grippers can be any other type of holding device that can engage expandable material 662.

A stimulus generator 668 can cause the expandable material 662 to expand and contract. To advance the piston into chamber 614, the second grippers can engage the expandable element 662, the first grippers 664 can release (not engage) the expandable element, and the stimulus generator can cause at least the length of expandable element 662 located between the grippers to expand. This action advances the end 670 of the expandable element 662 toward the piston 610. The first grippers 662 can then engage the expandable element 662 and the second grippers can disengage the expandable element 662, at which time the stimulus generator can cause the expandable material to contract. The cycle then begins again, with the first grippers disengaging, the second grippers engaging, and the expandable material expanding to push the piston further into the chamber.

Each cycle of the expandable material 662 and the grippers 664, 666 can cause the piston to advance a distance equal to the expansion distance of the portion of expandable material 662 located between the grippers. The process can repeat to cause the piston 610 to travel a distance that is substantially longer than the distance associated with a single expansion of the expandable material 662. Indeed, the piston can advance a distance equal to nearly the entire length of expandable material 662, one actuation at a time. When the piston 610 reaches a predetermined distance into the chamber 614, the process can be reversed to retract the piston 610 from the chamber 614. As with the linear pumps described above, the repeated actuations of piston 610 can draw fluid in through inlet port 618 and force it out through outlet 626.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

We claim:

1. A linear pump apparatus for pumping wellbore fluids, the linear pump apparatus comprising:

coiled production tubing operable to extend axially into a wellbore;

a first pump body suspended from the coiled production tubing, wherein an outer diameter the first pump body is substantially equal to an outer diameter of the coiled production tubing;

a first chamber located within the first pump body, the chamber including a first port extending through a wall of the coiled production tubing and operable to place the first chamber in fluid communication with a wellbore and a second port in fluid communication with the coiled production tubing extending toward a surface of the earth;

a first piston located within the first chamber, wherein the first port and the second port are located on a downstream side of the first piston, relative to a flow of wellbore fluids through the wellbore; and a first actuator located at an upstream side of the first piston, relative to a flow of wellbore fluids through the wellbore comprising an expandable material exhibiting at least one of piezoelectric, electrostriction, magnetostrictive, and piezomagnetism properties such that the expandable material is operable to change from a first shape to a second shape in response to an electromagnetic stimulus applied thereto, the change from the first shape to the second shape causing the piston to move axially from a first piston position to a second piston position, pushing the wellbore fluids in a downstream direction towards the surface of the earth;

a second pump body suspended from the coiled production tubing and axially spaced from the first pump body, wherein an outer diameter the second pump body is substantially equal to the outer diameter of the coiled production tubing;

a second chamber located within the second pump body, the second chamber including a third port extending through the wall of the coiled production tubing and operable to place the second chamber in fluid communication with the wellbore and a fourth port and in fluid communication with the coiled production tubing extending toward the surface of the earth;

a second piston located within the second chamber, wherein the third port and the fourth port are located on a downstream side of the second piston, relative to a flow of wellbore fluids through the wellbore; and a second actuator located at an upstream side of the second piston, relative to a flow of wellbore fluids through the wellbore comprising an expandable material exhibiting at least one of piezoelectric, electrostriction, magnetostrictive, and piezomagnetism properties such that the expandable material is operable to change from a first shape to a second shape in response to an electromagnetic stimulus applied thereto, the change from the first shape to the second shape causing the second piston to move axially from a first piston position to a second piston position, pushing the wellbore fluids in a downstream direction towards the surface of the earth.

2. The linear pump apparatus according to claim 1, wherein the first port is an opening through a surface of the pump body and being in communication with the first chamber, the first port being operable to allow fluid to pass through the first port; and wherein the second port is in communication with the first chamber.

3. The linear pump apparatus according to claim 2, wherein the first port comprises a switch.

4. The linear pump apparatus according to claim 2, wherein the first port is controlled with a valve.

5. The linear pump apparatus according to claim 1, further comprising a stimulus generator connected to the pump apparatus, wherein the stimulus generator provides the electromagnetic stimulus.

6. The linear pump apparatus according to claim 5, wherein the electromagnetic stimulus is an electrical charge, and wherein the expandable material exhibits at least one of piezoelectric and electrostriction properties.

7. The linear pump according to claim 5, wherein the stimulus is a magnetic field.

8. The linear pump apparatus according to claim 5, wherein a power supply is located on the surface of the earth and is connected to the stimulus generator.

9. The linear pump apparatus according to claim 1, wherein the first pump body is adapted to be submerged in a wellbore fluid in a wellbore and draw the wellbore fluid into the first chamber in response to movement of the first piston.

10. The linear pump apparatus according to claim 1, wherein each of the ports have a valve that is reversible so that the linear pump apparatus is operable to inject a fluid from the surface of the earth into the wellbore.

11. The linear pump apparatus according to claim 1, wherein the first pump body is adapted to intake a wellbore fluid from one subterranean wellbore zone through the first port and discharge the wellbore fluid into a different subterranean wellbore zone, and wherein the second pump body is adapted to intake the wellbore fluid from the different subterranean wellbore zone through the third port.

12. A system for pumping wellbore fluid, the system comprising:

a first linear pump, the first linear pump comprising:

a first pump body having an exterior surface;

a first chamber located within the first pump body, the first chamber in fluid communication with a wellbore through a first port, the first port being an opening through the exterior surface of the first pump, and the first chamber in fluid communication with well production tubing extending through the wellbore toward a surface of the earth through a second port, wherein an outer diameter the exterior surface of the first pump is substantially equal to the outer diameter of the production tubing;

a first piston located within the chamber, wherein the first port and the second port are located on a downstream side of the first piston, relative to a flow of wellbore fluids through the wellbore; and a first actuator comprising an expandable material located at an upstream side of the first piston, relative to a flow of wellbore fluids through the wellbore exhibiting at least one of piezoelectric, electrostriction, magnetostrictive, and piezomagnetism properties such that the expandable material is operable to change from a first shape to a second shape in response to an electromagnetic stimulus applied thereto, the change from the first shape to the second shape causing the first piston to move axially from a first piston position to a second piston position, the first piston being adapted to move wellbore fluid in a downstream direction towards the surface of the earth when moving from the first piston position to the second piston position; and a power supply to transmit power to the stimulus generator;

a second linear pump, the second linear pump comprising:

a second pump body having an exterior surface, wherein an outer diameter the exterior surface of the second pump is substantially equal to the outer diameter of the production tubing, a second chamber located within the second pump body;

a third port, the third port being an opening through the exterior surface of the second pump body and being in communication with the second chamber, a fourth port, the fourth port being in communication with the second chamber and in fluid communication with the well production tubing extending through the wellbore toward the surface of the earth, a second piston located within the second chamber, wherein the third port and the fourth port are located on a downstream side of the second piston, relative to a flow of wellbore fluids through the wellbore, and an expandable material located at an upstream side of the second piston, relative to a flow of wellbore fluids through the wellbore, the expandable material changing from a first shape to a second shape in response to an electrical stimulus from a stimulus generator, the change from the first shape to the second shape causing the second piston to move axially from a first piston position to a second piston position pushing the wellbore fluids in a downstream direction towards the surface of the earth; and wherein the first linear pump and the second linear pump are spaced axially apart in the well production tubing.

13. The system according to claim 12, wherein a valve located within the first port is selectively operable to allow wellbore fluid to flow through the port.

14. The system according to claim 13, wherein the first linear pump is adapted to be submerged in the wellbore fluid in the wellbore and draw the wellbore fluid from the wellbore, through the first port, into the chamber when the piston moves from the first piston position to the second piston position.

15. The system according to claim 12, wherein the first linear pump is located within the well production tubing and the second port adapted to communicate fluid between the chamber and the well production tubing.

16. The system according to claim 12, further comprising an annular packer forming a seal between an exterior surface of well production tubing and an outer tubing.

17. The system according to claim 12, further comprising a bypass tube coupled to the well production tubing on opposing axial sides of the second linear pump, such that the fluid pumped from the first pump bypasses the second pump.

18. The system according to claim 12, further comprising an umbilical connected to the power supply and at least the first linear pump and the second linear pump.

19. The system according to claim 12, wherein each of the ports have a valve that is reversible so that the system is operable to inject fluids from the surface of the earth into the wellbore.

20. The system according to claim 12, wherein the first port is fluidly coupled to one subterranean wellbore zone and the second port is fluidly coupled to a different subterranean wellbore zone such that the first linear pump intakes fluid from the one subterranean wellbore zone and discharges it into the different subterranean wellbore zone.

21. A method for pumping wellbore fluid from a wellbore, the method comprising:

creating a linear pump comprising a chamber, the chamber defined by a sidewall, and a piston, the chamber having an inlet valve connected to a passage through the sidewall, an outlet valve connected to tubing extending toward a surface of the earth, the inlet valve and outlet valve being located on a downstream side of the piston, relative to a flow of wellbore fluids through the wellbore, and an expandable material located on an upstream side of the piston, relative to a flow of wellbore fluids through the wellbore and in axial alignment with the piston to define a reciprocating linear motor pump, the expandable material exhibiting at least one of piezoelectric, electrostriction, magnetostrictive, and piezomagnetism properties;

suspending the reciprocating linear motor pump from a production tubing such that the inlet valve is in fluid communication with an exterior of the production tubing and the outlet valve is in fluid communication with an interior of the production tubing, wherein an outer diameter of the production tubing is substantially equal to an outer diameter of the reciprocating linear motor pump;

suspending a second reciprocating linear motor pump from the production tubing such that the second reciprocating linear motor is operable to pump fluid between a second inlet fluidly coupled to the exterior of the production tubing and a second outlet in fluid communication with the inlet of the reciprocating linear motor pump through the interior of the production tubing, the second reciprocating linear motor pump being spaced axially apart from the reciprocating linear motor pump, and wherein the outer diameter of the production tubing is substantially equal to an outer diameter of the second reciprocating linear motor pump;

submerging the reciprocating linear motor pump in a wellbore fluid in a wellbore;

axially contracting the expandable material to cause the piston to draw the wellbore fluid from outside the reciprocating linear motor pump, through the inlet valve, into the chamber, the outlet valve closing to prevent wellbore fluid from the tubing from entering the chamber and the inlet valve opening to allow wellbore fluid from outside the reciprocating linear motor pump to enter the chamber and then axially extending the expandable material to cause the piston to push wellbore fluid out of the chamber through the outlet valve and in a downstream direction towards the surface of the earth, the inlet valve closing to prevent wellbore fluid from exiting the chamber through the inlet valve and the outlet valve opening to allow wellbore fluid to exit the chamber through the outlet valve; and applying and removing alternating electric current from a stimulus generator to cause the expandable material to extend and contract.

22. The method according to claim 21, further comprising the step of placing a packer on the tubing between the reciprocating linear motor pump and the second reciprocating linear motor pump to isolate the inlet valves of the pumps from one another.

23. The method according to claim 22, wherein the packer isolates a first wellbore region from a second wellbore region, and further comprising the step selectively pumping from one of the wellbore regions.

24. The method according to claim 21, wherein each of the valves are reversible so that when the valves are reversed, the wellbore fluid is pumped from the surface of the earth into the wellbore.

25. The method according to claim 21, wherein the step of suspending the second reciprocating linear motor pump from the wellbore comprises placing the second reciprocating linear motor pump in a second subterranean wellbore zone with a higher or lower pressure than a first subterranean wellbore zone in which the reciprocating linear motor pump is disposed, and wherein the method further comprises operating the second reciprocating linear motor pump independently from the reciprocating linear motor pump to pump a different volume than the reciprocating linear motor pump.

26. The linear pump apparatus according to claim 1, wherein the first linear pump and the second linear pump are located within an outer production tubing, the outer production tubing being spaced a distance radially inward from a inner diameter surface of the wellbore.

27. The system according to claim 12, wherein the first linear pump and the second linear pump are located within an outer production tubing, the outer production tubing being spaced a distance radially inward from a inner diameter surface of the wellbore.

28. The method according to claim 21, wherein the step of submerging the reciprocating linear motor pump in the wellbore fluid in the wellbore includes lowering the reciprocating linear motor pump with the production tubing, through an outer production tubing that extends into the wellbore, the outer production tubing being spaced a distance radially inward from a inner diameter surface of the wellbore.

* * * * *